US012696978B1

(12) United States Patent
Murphy

(10) Patent No.: US 12,696,978 B1
(45) Date of Patent: Aug. 4, 2026

(54) RECLINING SEATING UNIT WITH STATIONARY BACK

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 177 days.

(21) Appl. No.: 18/636,484

(22) Filed: Apr. 16, 2024

Related U.S. Application Data

(60) Provisional application No. 63/496,475, filed on Apr. 17, 2023.

(51) Int. Cl.
*A47C 1/0355* (2013.01)
*A47C 1/034* (2006.01)

(52) U.S. Cl.
CPC ..... *A47C 1/0355* (2013.01); *A47C 1/0342* (2013.01)

(58) Field of Classification Search
CPC ..... A47C 1/0355; A47C 1/0342; A47C 1/035
See application file for complete search history.

(56) References Cited

U.S. PATENT DOCUMENTS 2,567,612 A * 9/1951 McGehee ..... A47C 3/0255 248/370
4,114,610 A * 9/1978 Koch ..... A61H 1/02 601/24
4,805,960 A * 2/1989 Tacker ..... A47C 1/0355 297/86
4,848,840 A * 7/1989 Toya ..... B60N 2/753 297/335
4,915,444 A * 4/1990 Rogers, Jr. ..... A47C 1/0355 297/69
5,326,153 A * 7/1994 Muffi ..... A47C 17/04 297/DIG. 7
5,588,710 A * 12/1996 Wiecek ..... A47C 1/0355 297/85 L
5,772,278 A * 6/1998 Kowalski ..... A47C 1/0355 297/85 L (Continued)

*Primary Examiner* — Medhat Badawi
(74) *Attorney, Agent, or Firm* — Myers Bigel, P.A.

(57) ABSTRACT

A reclining seating unit includes: a base; a stationary backrest attached to the base; a seat; a footrest; a reclining backrest; and a reclining mechanism attached to the base, the seat, the footrest and the reclining backrest. The reclining mechanism includes a plurality of pivotally interconnected links configured and arranged to move the seating unit between (a) an upright position, in which the reclining backrest is substantially vertical and just forward of the stationary backrest, the seat is substantially horizontal and positioned above the base and just forward of the reclining backrest, and the footrest is generally vertically disposed adjacent and below a front portion of the seat, (b) a TV position, in which the seat is moved forwardly relative to the base and takes a first pitch angle relative to horizontal, and the footrest is generally horizontally disposed and positioned in front of the seat, and (c) a fully reclined position, in which the seat is moved farther forward relative to the base, the reclining backrest takes a backrest angle relative to horizontal, and the seat takes a second pitch angle that is steeper than the first pitch angle. In the upright position, the reclining mechanism is between about 26 and 30 inches in length, and between about 6.5 and 8.0 inches in height.

11 Claims, 13 Drawing Sheets

(56) References Cited

U.S. PATENT DOCUMENTS 6,540,291 B2 * 4/2003 Hoffman ..... A47C 1/0355 297/84
6,554,354 B1 * 4/2003 Hoffman ..... A47C 7/70 297/145
6,588,841 B1 * 7/2003 Hoffman ..... A47C 3/0255 297/270.3
7,021,711 B1 * 4/2006 Hoffman ..... A47C 3/027 297/270.3
7,475,944 B2 * 1/2009 Griepentrog ..... A47C 17/175 297/85 L
7,607,180 B2 * 10/2009 Griepentrog ..... A47C 17/165 5/47
7,731,276 B2 * 6/2010 Hoffman ..... A47C 1/0355 297/259.2
8,016,359 B2 * 9/2011 Dillinger ..... B60N 2/753 297/411.32
8,297,693 B2 * 10/2012 Hoffman ..... A47C 3/0255 297/85 M
8,752,890 B2 * 6/2014 Murphy ..... A47C 1/037 297/423.35
9,156,385 B1 * 10/2015 Lewis ..... B60N 2/767
9,241,571 B2 * 1/2016 Robertson ..... A47C 1/031
9,332,844 B2 * 5/2016 Regev ..... A47C 3/025
9,398,812 B2 * 7/2016 Sanae ..... A47C 7/54
9,468,295 B2 * 10/2016 Lawson ..... A47C 1/0355
9,655,458 B2 * 5/2017 Jacobs ..... A47C 1/121
10,182,659 B2 * 1/2019 Kuhl ..... A47C 17/86
10,327,553 B2 * 6/2019 Kiwak ..... A47C 3/0251
10,441,081 B2 * 10/2019 Carrera ..... A47C 1/024
D885,783 S * 6/2020 Menescardi ..... D6/381
10,813,457 B2 * 10/2020 Kiwak ..... A47C 1/0345
10,874,574 B1 * 12/2020 Ruby ..... A61G 15/02
10,888,162 B1 * 1/2021 McLennan ..... A47C 1/124
11,076,700 B2 * 8/2021 Kuhl ..... A47C 17/04
11,110,023 B1 * 9/2021 Knight ..... A47C 1/03211
11,122,898 B2 * 9/2021 Kiwak ..... A47C 7/506
11,412,853 B2 * 8/2022 Kiwak ..... A47C 1/0347
11,457,742 B1 * 10/2022 Zhang ..... A47C 4/02
11,478,083 B1 * 10/2022 Li ..... A47C 17/04
11,564,496 B1 * 1/2023 Li ..... A47C 1/0355
11,832,726 B2 * 12/2023 Murphy ..... A47C 1/0355
11,832,727 B2 * 12/2023 Murphy ..... A47C 1/0355
12,458,146 B2 * 11/2025 Murphy ..... A47C 1/0355
2002/0093227 A1 * 7/2002 Williams ..... A47C 17/04 297/116
2002/0149238 A1 * 10/2002 Hoffman ..... A47C 1/03255 297/85 R
2003/0015893 A1 * 1/2003 Hoffman ..... G06F 17/142 297/85 R
2003/0022771 A1 * 1/2003 Stearns ..... A63B 21/4047 482/142
2003/0022772 A1 * 1/2003 Stearns ..... A63B 23/0405 482/142
2003/0070225 A1 * 4/2003 Murphy ..... A47C 17/2076 5/13
2005/0104420 A1 * 5/2005 Murphy ..... A47C 1/0355 297/85 L
2005/0146179 A1 * 7/2005 Murphy ..... A47C 1/124 297/248
2005/0253430 A1 * 11/2005 George ..... A47C 1/124 297/233
2006/0108840 A1 * 5/2006 Murphy ..... A47C 1/0355 297/68
2006/0284451 A1 * 12/2006 Hoffman ..... A47C 3/16 297/125
2006/0290174 A1 * 12/2006 Hoffman ..... A47C 1/0355 297/84
2007/0126267 A1 * 6/2007 Hoffman ..... A47C 1/0355 297/84
2007/0151023 A1 * 7/2007 Murphy ..... A47C 17/17 5/13
2007/0163475 A1 * 7/2007 Murphy ..... A47B 9/00 108/147
2007/0252368 A1 * 11/2007 Balser ..... B60R 21/0134 280/730.2
2007/0252422 A1 * 11/2007 Beaver ..... A47C 7/506 297/423.24
2007/0283491 A1 * 12/2007 Murphy ..... A47C 17/213 5/13
2008/0012396 A1 * 1/2008 Hoffman ..... A47C 1/0355 297/85 L
2008/0023992 A1 * 1/2008 Hoffman ..... A47C 1/0242 297/85 R
2008/0036248 A1 * 2/2008 Beaver ..... A47C 1/0355 297/329
2008/0079301 A1 * 4/2008 Schaaf ..... A47C 3/026 297/313
2009/0072593 A1 * 3/2009 Hoffman ..... A47C 1/037 297/408
2009/0235452 A1 * 9/2009 Hoffman ..... A47C 17/2076 5/13
2010/0127538 A1 * 5/2010 Hoffman ..... A47C 3/18 297/68
2010/0127555 A1 * 5/2010 Hoffman ..... A47C 3/0255 297/344.21
2010/0127556 A1 * 5/2010 Hoffman ..... A47C 1/0355 297/84
2010/0283297 A1 * 11/2010 Crum ..... A47C 7/50 297/423.28
2011/0010846 A1 * 1/2011 Murphy ..... A47C 17/04 5/2.1
2011/0010847 A1 * 1/2011 Murphy ..... A47C 17/04 5/35
2011/0018331 A1 * 1/2011 Murphy ..... A47C 1/0355 297/85 R
2011/0291460 A1 * 12/2011 Murphy ..... A61G 5/14 297/85 M
2011/0304193 A1 * 12/2011 Murphy ..... A47C 1/034 297/85 M
2012/0104827 A1 * 5/2012 Murphy ..... A47C 1/037 297/85 M
2012/0112517 A1 * 5/2012 Hoffman ..... A47C 1/0355 297/85 L
2012/0112518 A1 * 5/2012 Murphy ..... A47C 1/0355 297/85 L
2012/0112519 A1 * 5/2012 Murphy ..... A47C 1/0355 297/85 M
2012/0146364 A1 * 6/2012 Hoffman ..... A47C 1/03266 297/84
2012/0286557 A1 * 11/2012 Hoffman ..... A47C 1/03211 297/85 M
2013/0011335 A1 * 1/2013 Xie ..... G01N 33/5008 514/19.5
2013/0014327 A1 * 1/2013 Downey ..... A47C 7/42 5/632
2013/0140855 A1 * 6/2013 Murphy ..... A47C 1/037 297/61
2013/0140856 A1 * 6/2013 Murphy ..... A47C 1/037 297/61
2013/0175846 A1 * 7/2013 Lawson ..... A61G 5/14 297/85 M
2013/0200658 A1 * 8/2013 Hoffman ..... A47C 1/0342 297/75
2013/0200659 A1 * 8/2013 Hoffman ..... A47C 1/035 297/84
2014/0167482 A1 * 6/2014 Myre ..... A47C 7/002 297/463.1
2014/0345044 A1 * 11/2014 Murphy ..... A47C 17/225 5/14
2015/0135432 A1 * 5/2015 Murphy ..... A47C 17/16 5/29
2015/0282619 A1 * 10/2015 Lawson ..... A47C 1/0355 297/83
2015/0342358 A1 * 12/2015 Murphy ..... A61G 7/012 5/400
2016/0045031 A1 * 2/2016 Lawson ..... A47C 7/506 297/284.3
2016/0051057 A1 * 2/2016 Murphy ..... A47C 17/2073 5/29

(56) References Cited

U.S. PATENT DOCUMENTS

2016/0088942 A1* 3/2016 Murphy ..... A47C 1/0345 297/361.1
2016/0100686 A1* 4/2016 Regev ..... A47C 7/5068 297/270.1
2016/0100687 A1* 4/2016 Murphy ..... A47C 1/0347 297/271.3
2017/0071353 A1* 3/2017 Murphy ..... A47C 17/165
2017/0202359 A1* 7/2017 Murphy ..... A47C 17/207
2018/0027968 A1* 2/2018 Lawson ..... A47C 1/0355
2018/0064258 A1* 3/2018 Murphy ..... A47C 17/138
2018/0103761 A1* 4/2018 White ..... A47C 1/0352
2018/0161223 A1* 6/2018 Murphy ..... A61G 5/128
2018/0206644 A1* 7/2018 Murphy ..... A47C 3/18
2018/0297551 A1* 10/2018 Coakley ..... B60N 2/265
2020/0085197 A1* 3/2020 Lucas ..... A47C 15/004
2020/0100593 A1* 4/2020 He ..... A47C 7/38
2020/0100596 A1* 4/2020 He ..... A47C 17/00
2020/0163458 A1* 5/2020 Murphy ..... A47C 1/0355
2020/0352333 A1* 11/2020 Lapointe ..... A47C 1/0242
2021/0022506 A1* 1/2021 Murphy ..... A47C 1/03211
2021/0078450 A1* 3/2021 Tait ..... B60N 2/0292
2021/0100364 A1* 4/2021 Murphy ..... A47C 1/0355
2022/0378207 A1* 12/2022 Murphy ..... A47C 1/0355
2022/0400863 A1* 12/2022 Murphy ..... A47C 1/0242
2023/0010099 A1* 1/2023 Murphy ..... A47C 1/037
2023/0017194 A1* 1/2023 Slater ..... A47C 17/04
2023/0068014 A1* 3/2023 Sun ..... A47C 1/03211
2023/0200536 A1* 6/2023 Beech ..... A47C 31/008 297/463.1
2023/0232987 A1* 7/2023 Brandtner ..... A47C 5/12 297/452.55
2023/0380597 A1* 11/2023 Li ..... A47C 1/0355
2024/0023713 A1* 1/2024 Murphy ..... A47C 1/0345
2024/0041215 A1* 2/2024 Spong ..... A47C 1/03255
2024/0049885 A1* 2/2024 Kamiya ..... A47C 7/54
2024/0081540 A1* 3/2024 Chen ..... A47C 7/541
2024/0122346 A1* 4/2024 Murphy ..... A47C 1/0355
2024/0138568 A1* 5/2024 Yang ..... A47C 1/0355
2024/0138569 A1* 5/2024 Murphy ..... A47C 3/0255
2024/0138577 A1* 5/2024 Yang ..... A47C 1/03211
2024/0148144 A1* 5/2024 Li ..... A47C 1/0345
2024/0148145 A1* 5/2024 Li ..... A47C 1/0355
2024/0148148 A1* 5/2024 Shao ..... A47C 4/028
2024/0156262 A1* 5/2024 Li ..... A47C 1/0355
2024/0156263 A1* 5/2024 Li ..... A47C 1/0347
2024/0156274 A1* 5/2024 Hall ..... B66D 1/60
2024/0164527 A1* 5/2024 Li ..... A47C 7/5068
2024/0206632 A1* 6/2024 Shi ..... A47C 19/022
2024/0215726 A1* 7/2024 Li ..... A47C 1/0345
2024/0277145 A1* 8/2024 Li ..... A61G 5/14
2024/0277150 A1* 8/2024 Cooper ..... A47C 15/006
2024/0298805 A1* 9/2024 Li ..... A47C 7/5068
2024/0335039 A1* 10/2024 Lake ..... A47C 1/0355
2024/0335042 A1* 10/2024 Liu ..... A47C 1/024
2024/0341478 A1* 10/2024 Zhao ..... A47C 3/03
2024/0341479 A1* 10/2024 Murphy ..... A47C 1/0355
2024/0358156 A1* 10/2024 Wu ..... A47C 7/546
2024/0365979 A1* 11/2024 Lawson ..... A47C 1/0355
2024/0374031 A1* 11/2024 Tan ..... A47C 1/0355
2024/0374032 A1* 11/2024 Sun ..... A47C 1/0355
2024/0389751 A1* 11/2024 Sun ..... A47C 1/03211
2024/0407545 A1* 12/2024 Shi ..... H04R 1/025
2024/0423369 A1* 12/2024 Loccioni ..... A47C 1/0342
2025/0000260 A1* 1/2025 Cai ..... A47C 1/0355
2025/0040708 A1* 2/2025 Lake ..... A47C 1/0355
2025/0040709 A1* 2/2025 Lake ..... A47C 1/0355
2025/0057317 A1* 2/2025 Zhou ..... A47C 17/86
2025/0072612 A1* 3/2025 Zhao ..... A47C 1/0355
2025/0082099 A1* 3/2025 Ye ..... A47C 1/03211
2025/0089902 A1* 3/2025 Chen ..... A47C 17/2076
2025/0098864 A1* 3/2025 Shi ..... A47C 7/541
2025/0107624 A1* 4/2025 Dick ..... A47C 1/0355
2025/0134256 A1* 5/2025 Conner ..... A47C 1/121
2025/0151906 A1* 5/2025 Yang ..... A47C 1/0355
2025/0151908 A1* 5/2025 Lei ..... A47C 1/0242
2025/0160520 A1* 5/2025 Cai ..... A47C 1/0345
2025/0160521 A1* 5/2025 Cai ..... A47C 1/0345
2025/0228368 A1* 7/2025 Wang ..... A47C 1/03211
2025/0248521 A1* 8/2025 Jiang ..... A47C 1/0345
2025/0261757 A1* 8/2025 Crum ..... A47C 1/03211
2025/0280955 A1* 9/2025 Murphy ..... A47C 15/004
2025/0288112 A1* 9/2025 Ding ..... A47C 7/624
2025/0288116 A1* 9/2025 Shi ..... A47C 17/17
2025/0295236 A1* 9/2025 Johnson ..... A47C 1/121
2025/0311848 A1* 10/2025 López Ramírez ..... A47C 1/035

* cited by examiner

RECLINING SEATING UNIT WITH STATIONARY BACK

RELATED APPLICATION

The present application claims priority from and the benefit of U.S. Provisional Patent Application No. 63/496,475, filed Apr. 17, 2023, the disclosure of which is hereby incorporated herein by reference in full.

FIELD OF THE APPLICATION

The present invention relates generally to seating units, and more particularly to reclining seating units.

BACKGROUND

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability. Other reclining chairs may have decoupled reclining and footrest-extending mechanisms. See, e.g., U.S. Pat. No. 7,731,276 to Hoffman et al. Some reclining units have employed power actuators to recline the backrest and extend the footrest. See, e.g., U.S. Pat. No. 8,297,693 to Hoffman et al.

SUMMARY

As a first aspect, embodiments of the invention are directed to a reclining seating unit. The reclining seating unit comprises: a base; a stationary backrest attached to the base; a seat; a footrest; a reclining backrest; and a reclining mechanism attached to the base, the seat, the footrest and the reclining backrest. The reclining mechanism comprises a plurality of pivotally interconnected links configured and arranged to move the seating unit between (a) an upright position, in which the reclining backrest is substantially vertical and just forward of the stationary backrest, the seat is substantially horizontal and positioned above the base and just forward of the reclining backrest, and the footrest is generally vertically disposed adjacent and below a front portion of the seat, (b) a TV position, in which the seat is moved forwardly relative to the base and takes a first pitch angle relative to horizontal, and the footrest is generally horizontally disposed and positioned in front of the seat, and (c) a fully reclined position, in which the seat is moved farther forward relative to the base, the reclining backrest takes a backrest angle relative to horizontal, and the seat takes a second pitch angle that is steeper than the first pitch angle. In the upright position, the reclining mechanism is between about 26 and 30 inches in length, and between about 6.5 and 8.0 inches in height.

As a second aspect, embodiments of the invention are directed to a reclining seating unit comprising: a base; a stationary backrest attached to the base; a seat; a footrest; a reclining backrest; a reclining mechanism attached to the base, the seat, the footrest and the reclining backrest; and a linear actuator. The reclining mechanism comprises a plurality of pivotally interconnected links configured and arranged to move the seating unit between (a) an upright position, in which the reclining backrest is substantially vertical and just forward of the stationary backrest, the seat is substantially horizontal and positioned above the base and just forward of the reclining backrest, and the footrest is generally vertically disposed adjacent and below a front portion of the seat, (b) a TV position, in which the seat is moved forwardly relative to the base and takes a first pitch angle relative to horizontal, and the footrest is generally horizontally disposed and positioned in front of the seat, and (c) a fully reclined position, in which the seat is moved farther forward relative to the base, the reclining backrest takes a backrest angle relative to horizontal, and the seat takes a second pitch angle that is steeper than the first pitch angle. The linear actuator includes a rail and a carriage movable on the rail, the linear actuator attached to the reclining mechanism and configured to move the seating unit between the upright, TV and fully reclined positions. The reclining mechanism includes an upper footrest extension link and a footrest bracket, wherein the footrest bracket is fixed to the footrest, and wherein the footrest bracket is directly pivotally attached to the upper footrest extension link at a front end of the upper footrest extension link, and wherein a rear end of the upper footrest extension link is positioned adjacent a rear end of the seat when the seating unit is in the upright position. The reclining mechanism further includes (a) a drive link that is pivotally attached to the carriage of the linear actuator, (b) an actuation transition link that is pivotally attached to the drive link and to the seat, and (c) a coupling link that is pivotally attached to the actuation transition link, wherein the drive link includes an arcuate slot and the coupling link includes a pin that is received in the arcuate slot.

DETAILED DESCRIPTION

Figure 1:
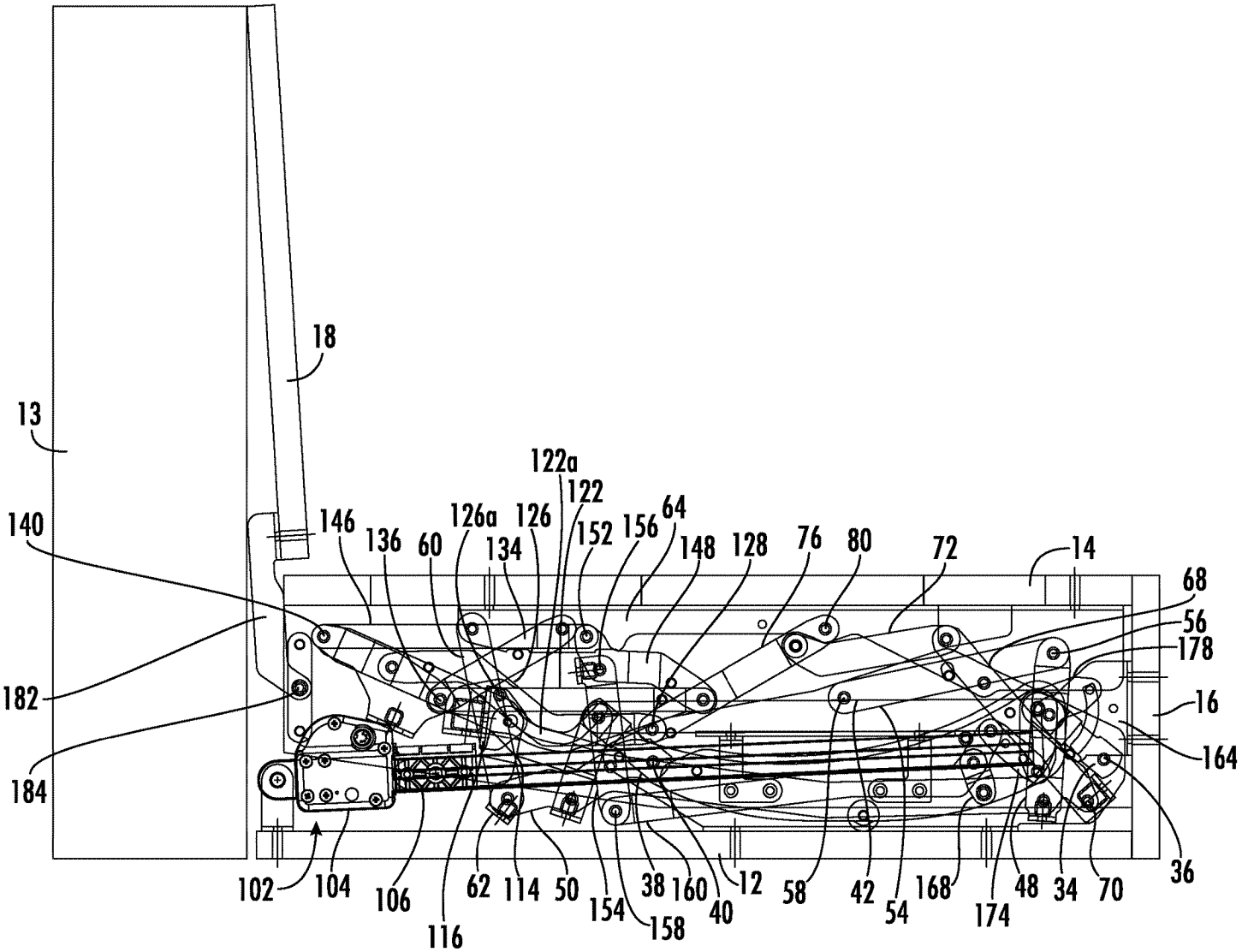
FIG. 1 is a side view of a seating unit according to embodiments of the invention, wherein the seating unit is shown in the upright position.
Figure 2:
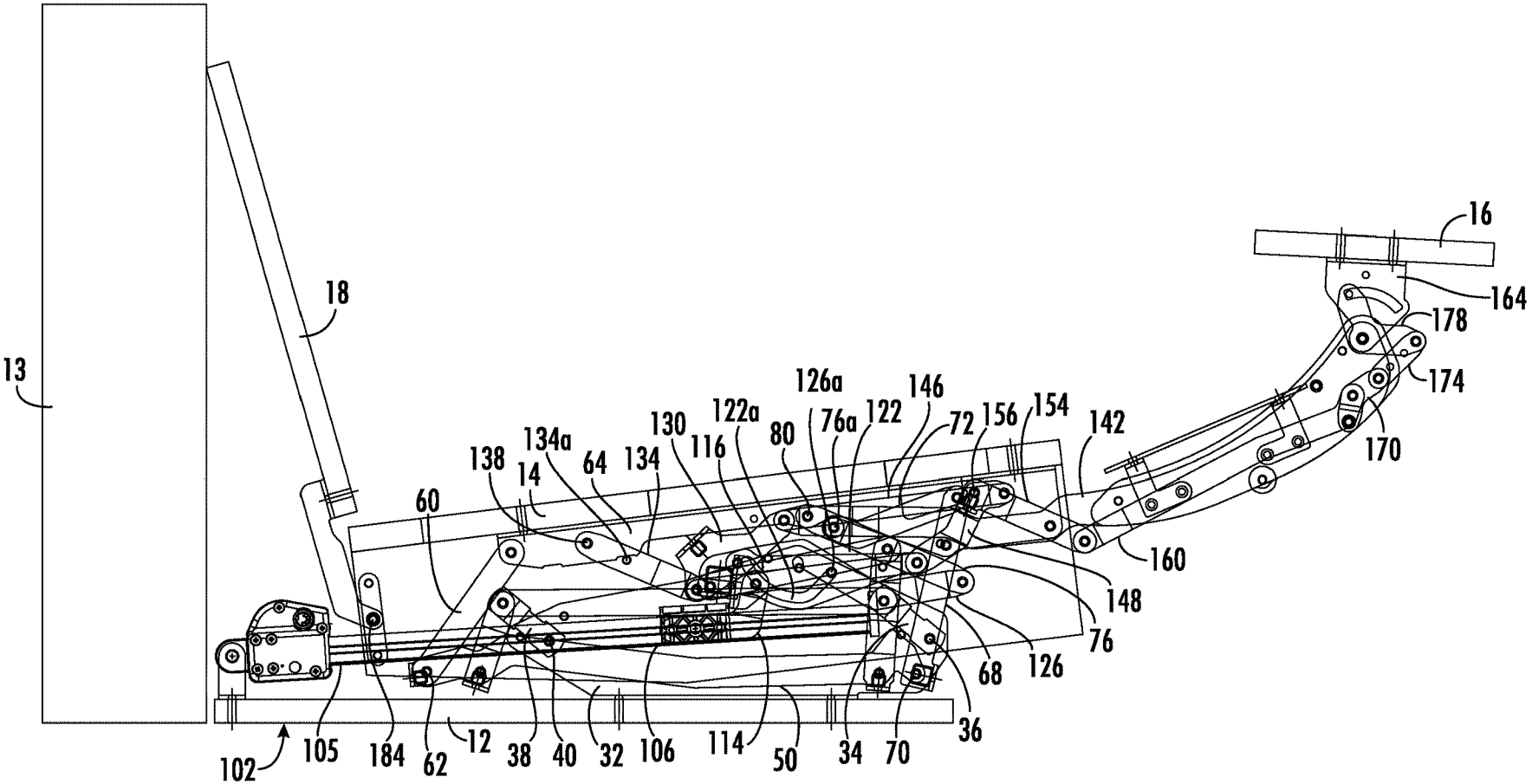
FIG. 2 is a side view of the seating unit of FIG. 1, shown in the TV position.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the drawings, a reclining seating unit, designated broadly at 10, is shown in FIGS. 1-7D. The reclining seating unit 10 includes a base 12, a stationary backrest 13 that is fixed to the rear end of the base 12, a seat 14, a footrest 16, and a reclining backrest 18. Side boards 21 depend from the seat 14. A pair of reclining mechanisms 30 are attached to the base 12, the seat 14, the footrest 16, and the reclining backrest 18. The reclining mechanisms 30 are mirror images of each other relative to a vertical plane P (FIG. 5) that is bisects the seating unit 10. As such, only one reclining mechanism 30 will be described herein, with the understanding that the discussion is equally applicable to the mirror image reclining mechanism 30. Also, as used herein, the terms "front," "forward" and the like refer to a horizontal direction defined by a vector the originates in the backrest and extends parallel to the plane P toward the footrests (in other words, the forward direction is consistent with an occupant of the seating unit facing forward). The term "rear" and the like refer to the direction opposite to the forward direction. Together the front and rear directions make up the "longitudinal" dimension of the seating unit 10. The "lateral" dimension of the seating unit 10 is perpendicular to the plane P.

Further, the reclining mechanisms 30 are configured to move the seating unit 10 between (a) an upright position, in which the reclining backrest 18 is generally upright, the seat 14 is generally horizontal, and the footrest 16 is disposed beneath the front portion of the seat 14 (see FIGS. 1 and 6A), (b) a TV position (FIGS. 2 and 6F), in which the reclining backrest 18 is slightly reclined, the seat 14 has moved forwardly and upwardly and taken on a slight pitch angle, and the footrest 16 is extended in front of the seat and disposed generally horizontally, and (c) a fully reclined position (FIGS. 3 and 7D), in which the reclining backrest 18 is further reclined relative to its disposition in the upright position, the footrest 16 remains disposed in front of the seat 14, and the seat 14 has moved further forwardly relative to the base 12 and has a great pitch angle.

Figure 3:
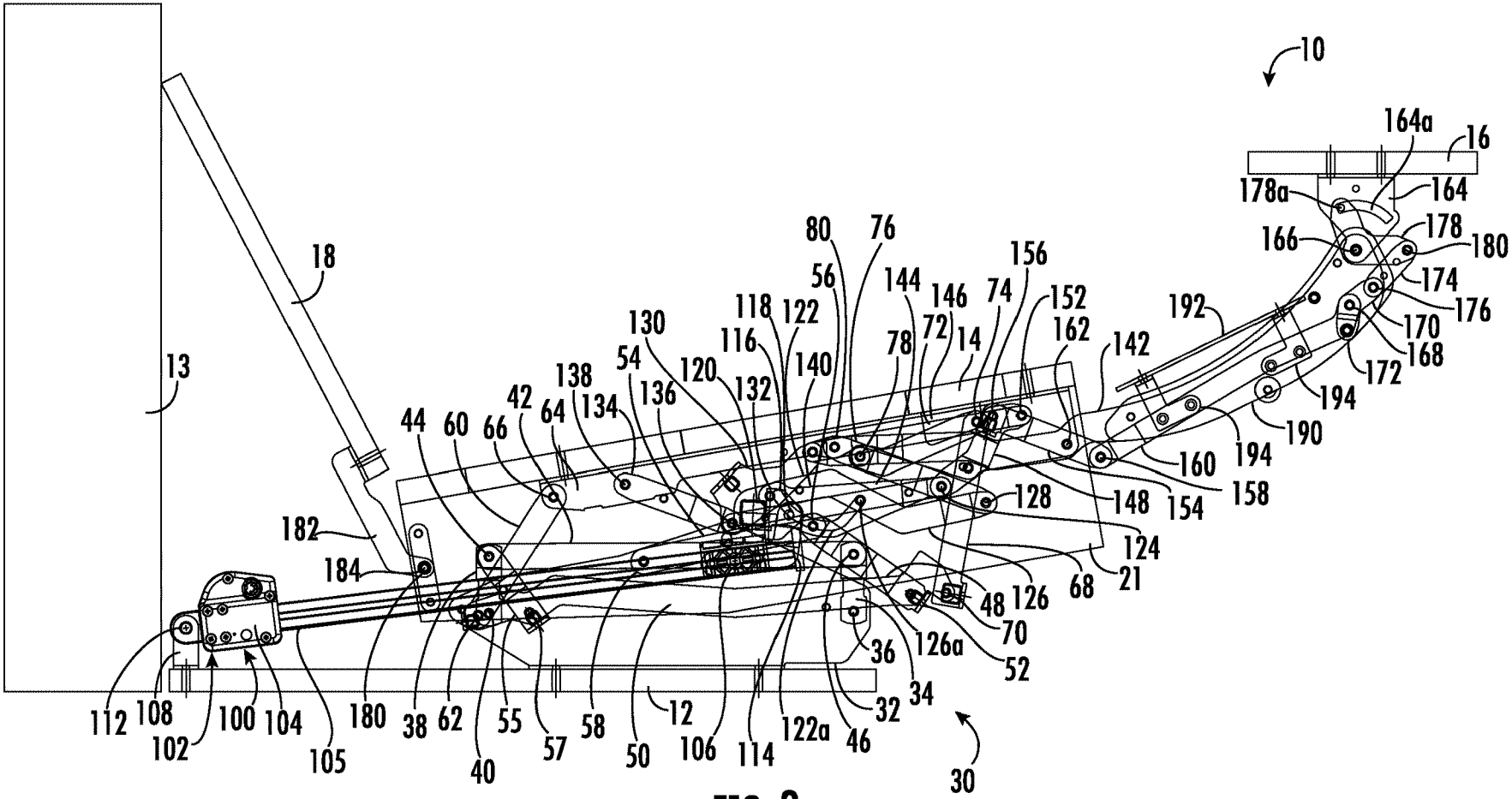
FIG. 3 is a side view of the seating unit of FIG. 1, shown in the fully reclined position.
Figure 7A:
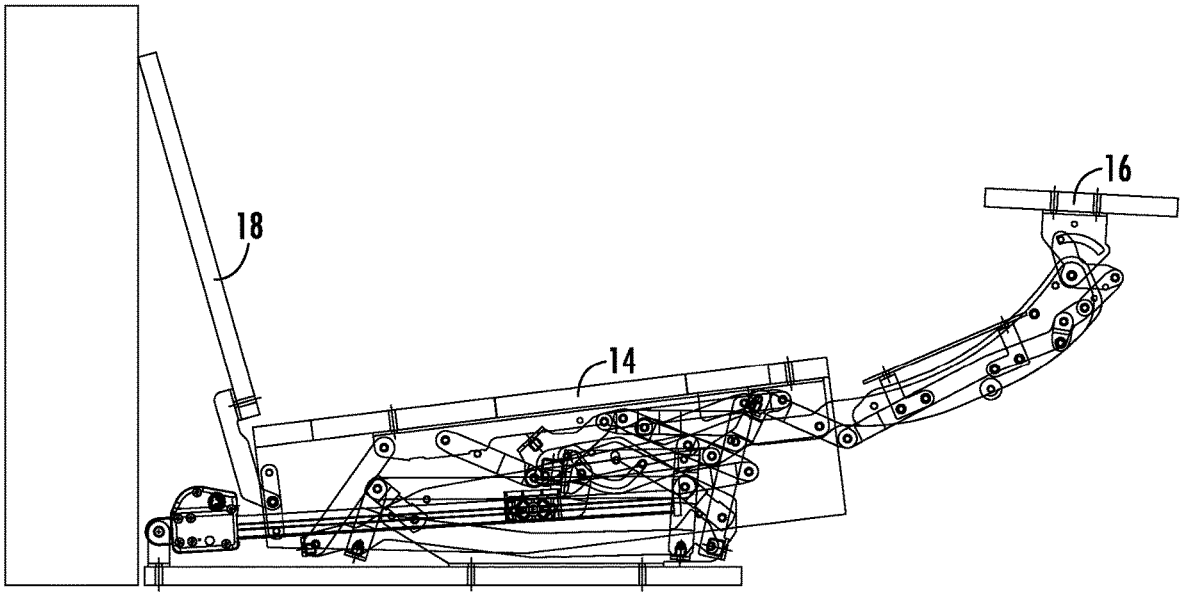
FIGS. 7A-7D are sequential views of the seating unit of FIG. 1 showing different positions of links of the reclining mechanism and footrest linkage as the seating unit moves between the TV and fully reclined positions.
Figure 7B:
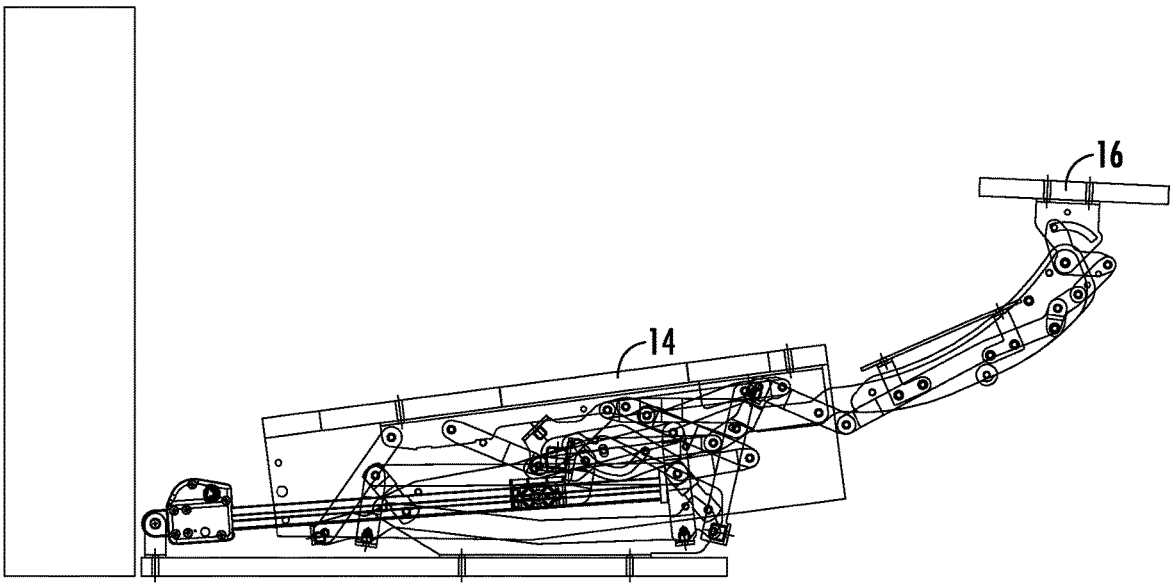
Figure 7C:
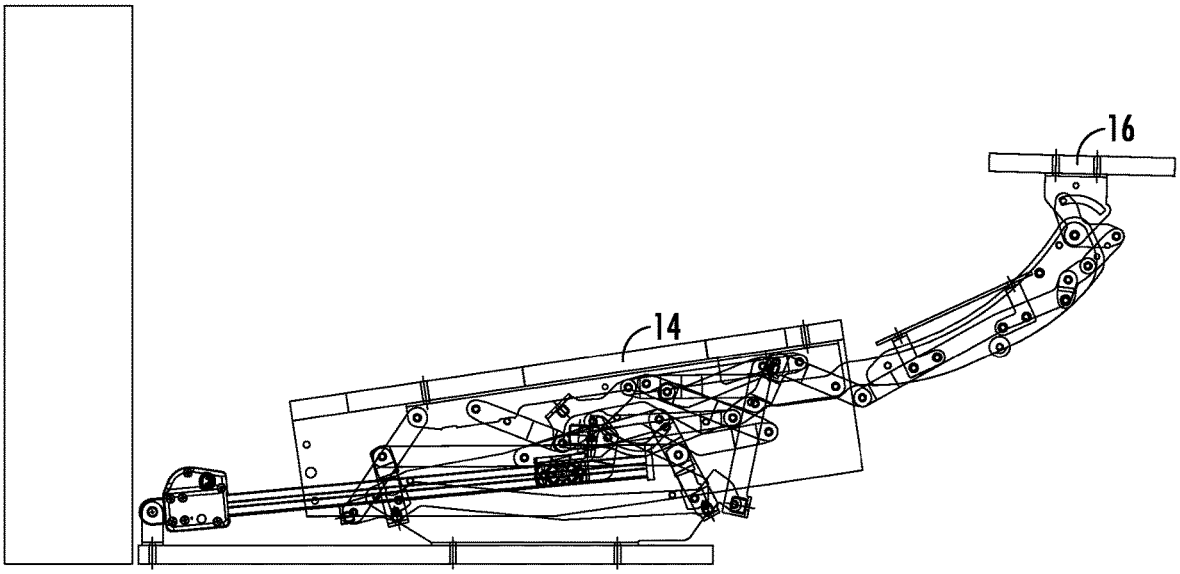
Figure 7D:
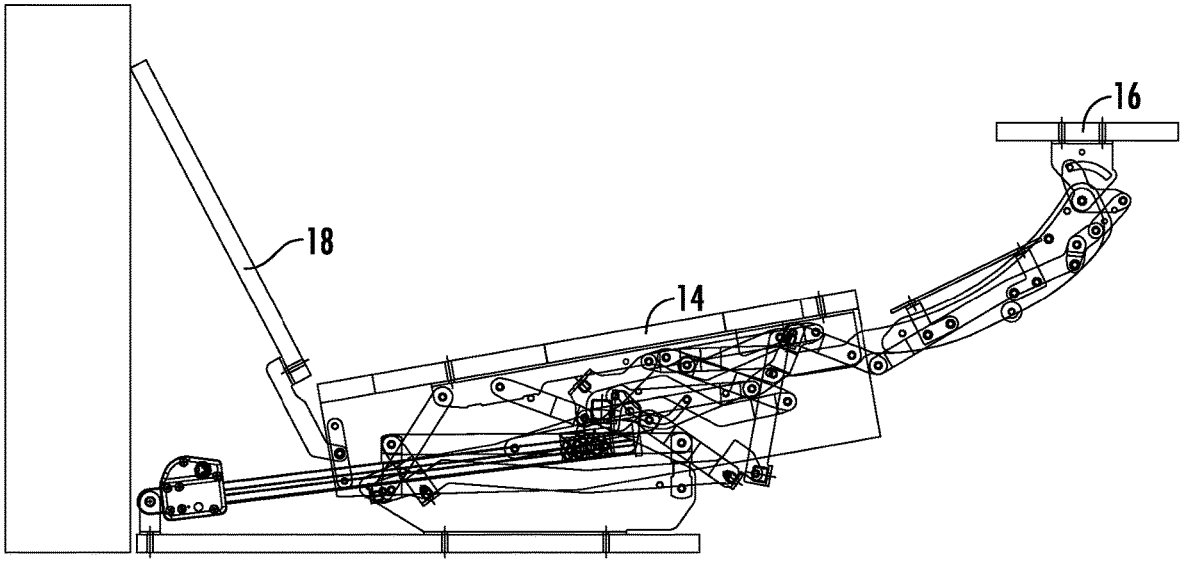

For the sake of clarity, the reclining mechanisms 30 will first be described in the fully reclined position (FIGS. 3 and 7D).

Referring to FIG. 3, a foundation plate 32 is fixed to and extends upwardly from the base 12. A front swing link 34 is attached to a front portion of the foundation plate 32 at a pivot 36 and extends upwardly therefrom. A rear swing link 38 is attached to a rear portion of the foundation plate 32 at a pivot 40 and extends upwardly therefrom. A connecting link 42 extends between the upper ends of the rear and front swing links 38, 34 and is attached thereto via pivots 44, 46, respectively. The central portion of a transition link 48 is attached to the front swing link 34 at the pivot 46. At its lower, forward end, the transition link 48 is attached to the front end of a carrier link 50 at a pivot 52. The upper, rearward end of the transition link 48 is attached to the forward end of a control link 54 at a pivot 56. The rear end of the control link 54 is attached to a central region of the foundation plate 32 at a pivot 58. A short straight link 55 is attached to a rear portion of the carrier link 50 at a pivot 57 and to the rear swing link 38 and the connecting link 42 at the pivot 44.

Still referring to FIG. 3, a rear drive link 60 is attached to the rear end of the carrier link 50 at a pivot 62 and extends upwardly and forwardly therefrom. A seat link 64 underlies the seat 14 and is attached to the upper end of the rear drive link 60 at a pivot 66. A front drive link 68 is attached at a pivot 70 to the forward end of the carrier link 50 and extends upwardly and forwardly therefrom. An angled link 72 is attached to the upper end of the front drive link 68 at a pivot 74 and extends rearwardly therefrom. An actuation transition link 76 is attached to the rear end of the angled link 72 at a pivot 78, and is also attached to the seat link 64 at a pivot 80 that is just rearward and upward from the pivot 78.

The seating unit 10 includes an actuating linkage 100 that is designed to move the seating unit 10 between the upright, TV and fully reclined positions. The actuating linkage 100 includes a linear actuator 102 with a motor 104, a rail 105 that extends forwardly of the motor 104, and a carriage 106 that moves along the path defined by the rail 105. The motor 104 is attached to a bracket 108 that is fixed to the rear portion of the base 12 at a pivot 112. A bracket 114 is fixed to the carriage 106. A flanged link 116 is attached to an upper end of the bracket 114 at a pivot 118. The flanged link 116 is fixed to a cross-member 120 that extends laterally across the seating unit 10. The cross-member 120 is fixed to a flange of a drive link 122. The forward end of the drive link 122 is attached to an intermediate region of the actuation transition link 76 at a pivot 124.

A tripartite coupling link 126 is attached at the lower end of the actuation transition link 76 at a pivot 128. In its central section, the coupling link 126 includes a pin 126*a* that is received in an arcuate slot 122*a* in the drive link 122. The rear end of the coupling link 126 is attached to a shoe-shaped link 130 at a pivot 132. A tying link 134 is attached at its forward end via a pivot 136 to the "heel" of the shoe-shaped link 130, and is attached at its rearward end to the seat link 64 at a pivot 138. The "toe" of the shoe-shaped link 130 is attached at a pivot 140 to a lengthy upper footrest extension link 142. A straight link 144 is attached to the tying link 134 and the shoe-shaped link 130 at the pivot 136 and extends forward to share the pivot 124 between the drive link 122 and the actuation transition link 76.

A straight link 146 shares the pivot 140 with the shoe-shaped link 130 and the upper footrest extension link 142. A pivot link 148 shares the pivot 124 with the drive link 122, the actuation transition link 76, and the straight link 144. The pivot link 148 extends upwardly and forwardly therefrom to attach with the straight link 144 at a pivot 152.

A footrest swing link 154 is attached to the pivot link 148 at a pivot 156 located just rearwardly of the pivot 152. The footrest swing link 154 extends forwardly to attach at a pivot 158 with a lower footrest extension link 160. The footrest swing link 154 also attaches to the upper footrest extension link 142 at a pivot 162. The upper footrest extension link 142 extends forwardly and upwardly to attach to a footrest bracket 164 at a pivot 166. The footrest 16 is mounted on the footrest bracket 164. The lower footrest extension link 160 extends forwardly and upwardly to a pivot 168 with a crank 170 that is also pivotally attached to the upper footrest extension link 142 at a pivot 172 located just below the pivot 168. The upper, forward end of the crank 170 is attached to a control link 174 at a pivot 176. An angled link 178 is attached to the upper end of the control link 174 at a pivot 180 and at its vertex to the upper footrest extension link 142 and the footrest bracket 164 at the pivot 166. A pin 178*a* is mounted on the angled link 178 and is received in an arcuate slot 164*a* in the footrest bracket 164.

Also shown in FIG. 3, a shield 190 is fixed to and moves with the upper footrest extension link 142. A cover 192 is also fixed to and moves with the upper footrest extension link 142 via L-shaped brackets 194.

Referring still to FIG. 3, a base link 180 is fixed to the side board 21. A backpost 182 is attached to the base link 180 at a pivot 184 and extends upwardly therefrom. The backrest 18 is fixed to and moves in concert with the backpost 182.

As noted above, FIG. 1 illustrates the seating unit 10 in the upright position, in which the footrest 16 is retracted, the backrest 18 is substantially vertical, and the seat 14 is substantially horizontal (i.e., has virtually no pitch angle). As can be seen in FIG. 1, in the upright position the carriage 106 of the linear actuator 102 is positioned rearwardly on the rail 105 adjacent the motor 104. The front and rear swing links 34, 38 both extend upwardly and rearwardly from the pivots 36, 40, respectively. The connecting link 42 is generally horizontally disposed. The transition link 48 is substantially vertical. The carrier link 50 is generally horizontal and resides near the base 12. The control link 54 tilts slightly downwardly as it extends rearwardly from the pivot 56 to the pivot 58 with the foundation plate 32. The rear drive link 60 extends upwardly and rearwardly from the pivot 62. The seat link 64 is substantially horizontal, therefore rendering the seat 14 substantially horizontal. The front drive link 68 extends upwardly and rearwardly from the pivot 70. The angled link 72 is generally horizontal. The actuation transition link 76 extends downwardly and rearwardly from the pivot 80 to the pivot 128 with the coupling link 126.

Referring still to FIG. 1, with the carriage 106 (and in turn the bracket 114) in a rearmost position as described above, the flanged link 116 is oriented with the flange facing rearwardly. The drive link 122 is substantially horizontal. The coupling link 126 is generally horizontal, with the pin 126*a* at the rear end of the slot 122*a*. The shoe-shaped link 130 is inverted, with the "sole" of the "shoe" facing generally upwardly. The tying link 134 extends upwardly and forwardly from the pivot 136 to the pivot 138.

Referring still to FIG. 1, the upper ottoman extension link 142 is generally horizontal and extends from the pivot 140 forwardly for most of the longitudinal dimension of the seat 14. The straight link 146 is substantially horizontal and extends forwardly from the pivot 140. The pivot link 148 extends forwardly and downwardly from the pivot 152. The footrest swing link 154 extends downwardly from the pivot 156. The lower footrest extension link 160 is positioned near the base 12 and extends forwardly from the pivot 158. The footrest bracket 164 is oriented so that the surface attached to the footrest 16 faces forwardly, thereby positioning the footrest at the front of the seating unit 10 just below the seat 14. The crank 170 is generally upright, the control link 174 extends forwardly and downwardly from the pivot 176, and the angled link 178 is substantially vertical.

FIGS. 6A-6F illustrate sequentially the movement of the seating unit 10 from the upright position to the TV position. To move the seating unit 10 from the upright position of FIG. 1 to the TV position of FIG. 2, the occupant of the seating unit 10 actuates the linear actuator 102 (typically via a push button, toggle switch, joystick or the like) to move the carriage 106 forwardly along the rail 105. Forward movement of the carriage 106 forces the bracket 114, the flanged link 116, and the drive link 122 forward. Forward movement of the drive link 122 forces the actuation transition link 76 to rotate counterclockwise about the pivot 80, and draws the pivot link 148 forward. The rotation of the actuation transition link 76 draws the pivot link 148 forward, which also draws the straight link 146 forward. The forward movement of the straight link 146 rotates the shoe-shaped link 130 clockwise and draws the upper ottoman extension link 142 forward. At the same time, the rotation of the straight link 146 draws the coupling link 126 forward relative to the drive link 122, such that the pin 126*a* moves to the forward end of the slot 122*a*. The shoe-shaped link 130 also moves forward, causing the tying link 134 to rotate counterclockwise about the pivot 138.

Rotation of the actuation transition link 76 also forces the angled link 72 forward, which in turn rotates the front link 68 clockwise about the pivot 70. The movement of the front drive link 68 moves the seat link 64, and thus the seat 14, forward relative to the base 12. Forward movement of the seat link 64 also rotates the rear drive link 60 clockwise about the pivot 62.

The forward movement of the upper footrest extension link 142 rotates the footrest swing link 154 counterclockwise about the pivot 156. This movement drives the lower footrest extension link 160 forwardly and slightly upwardly. Forward movement of the lower footrest extension link 160 relative to the upper footrest extension link 142 forces the crank, control link and angled link 170, 174, 178 to rotate so that the footrest bracket 164 rotates to move the footrest 16 to face upwardly.

The forward movement of the seat 14 causes the reclining backrest 18 (which is supported at its top edge by the stationary backrest 13) to pivot counterclockwise about the pivot 184. Thus, the reclining angle of the backrest 18 increases slightly in the TV position.

Movement of the seating unit 10 to the TV position ceases when a stop pin 134*a* on the tying link 134 contacts the lower edge of the seat link 64, and when a larger stop disk 76*a* mounted on the actuation transition link 76 coincident with the pivot 78 contacts the lower edge of the seat link 64.

Notably, as the movements of links described above are occurring, the rear and front swing links 34, 38 do not move relative to the foundation plate 32. As a result, the carrier link 50 remains in essentially the same position relative to the foundation plate 32. The degree to which the rear and front swing links 34, 38 are inclined to the rear creates a sufficiently high resistance to pivoting that the links described above the move the seat 14 and the footrest 16 move preferentially to the rear and front swing links 34, 38. Thus, in essence the carrier link 50 serves as a foundation for the movement of the seat 14 and the footrest 16 during movement of the seating unit 10 from the upright position to the TV position.

FIGS. 7A-7D illustrate sequentially the movement of the seating unit 10 from the TV position to the fully reclined position. To move the seating unit 10 from the TV position to the fully reclined position, the user activates the linear actuator 102 to move the carriage 106 farther forwardly on the rail 105. This movement forces the bracket 114, the flanged link 116, and the drive link 122 to move forwardly relative to the base 12. However, because the footrest 16 is fully extended in front of the seat 14, the links that extend the footrest 16 in front of the seat 14 do not move relative to each other, but instead move forwardly relative to the base 12 as a unit. As part of the movement of this unit, the front drive link 68 moves the carrier link 50 forward relative to the foundation plate 32. This movement draws the lower end of the transition link 48 forward, which rotates the front swing link 34 about the pivot 36. The rotation of the front swing link 34 draws the connecting link 42 forward, which in turn draws the rear swing link 38 to rotate about the pivot 40. The rising and forward movement of the carrier link 50 cause the seat 14 and the extended footrest 16 to move forward as a unit, and for the seat pitch angle to increase.

Also, because the seat 14 moves forward relative to the base 12, the pivot 184 between the backpost 182 and the base link 180 moves forward, allowing the backrest 18 to recline further relative to horizontal (while the upper end of the backrest is still supported by the stationary backrest 18).

The seating unit 10 may be particularly suitable for use with pieces for a sectional sofa or the like. One exemplary sectional sofa design, sold under the name LOVESAC®, includes sectional pieces that that can easily be combined to form a love seat, a sofa, a "90 degree' sofa, or the like. The sections have a relatively low seat height (e.g., between about 8 and 12 inches below a seat cushion) and a depth (front-to-back) of between about 26 and 35 inches, and lack arms to enable the sections to be disposed side-by-side. Because the sections are intended to be interchangeable so that each user can customize his/her own arrangement, all of the section have the same seat height and depth. Thus, the introduction of a reclining mechanism, such as the reclining mechanism 30, requires that the reclining mechanism provide the desired reclining functionality while still fitting within the volume defined by the base, the seat, the footrest, and the stationary backrest when the seating unit is in the upright position. The reclining mechanism 30 can provide such functionality; in some embodiments, the reclining mechanism 30 is between about 26 and 30 inches in length (front-to-back), and between about 6.5 and 8 inches in height.

Figure 4:
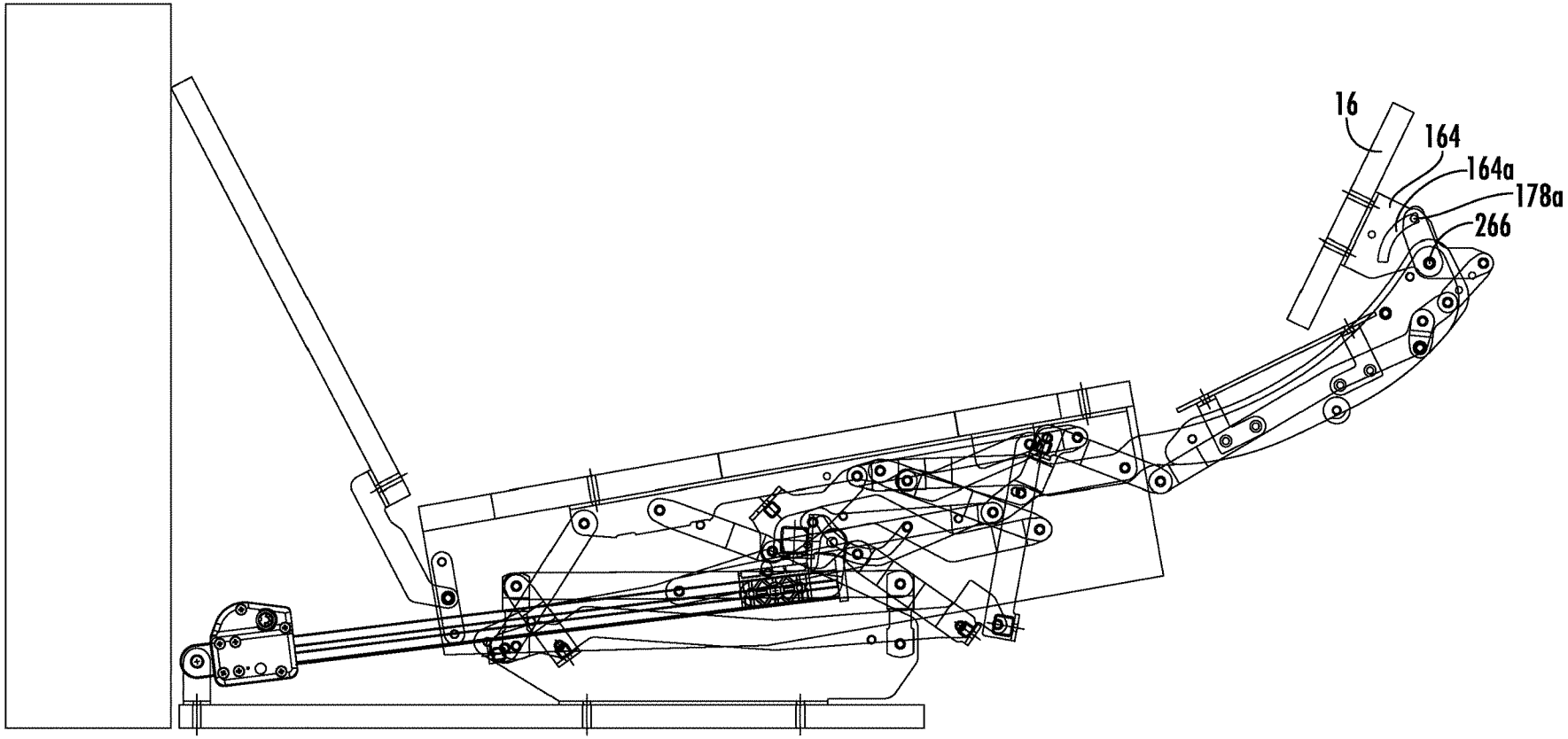
FIG. 4 is a side view of the seating unit of FIG. 1, shown in the fully reclined position with the footrest tilted toward the remainder of the seating unit.
Figure 5:
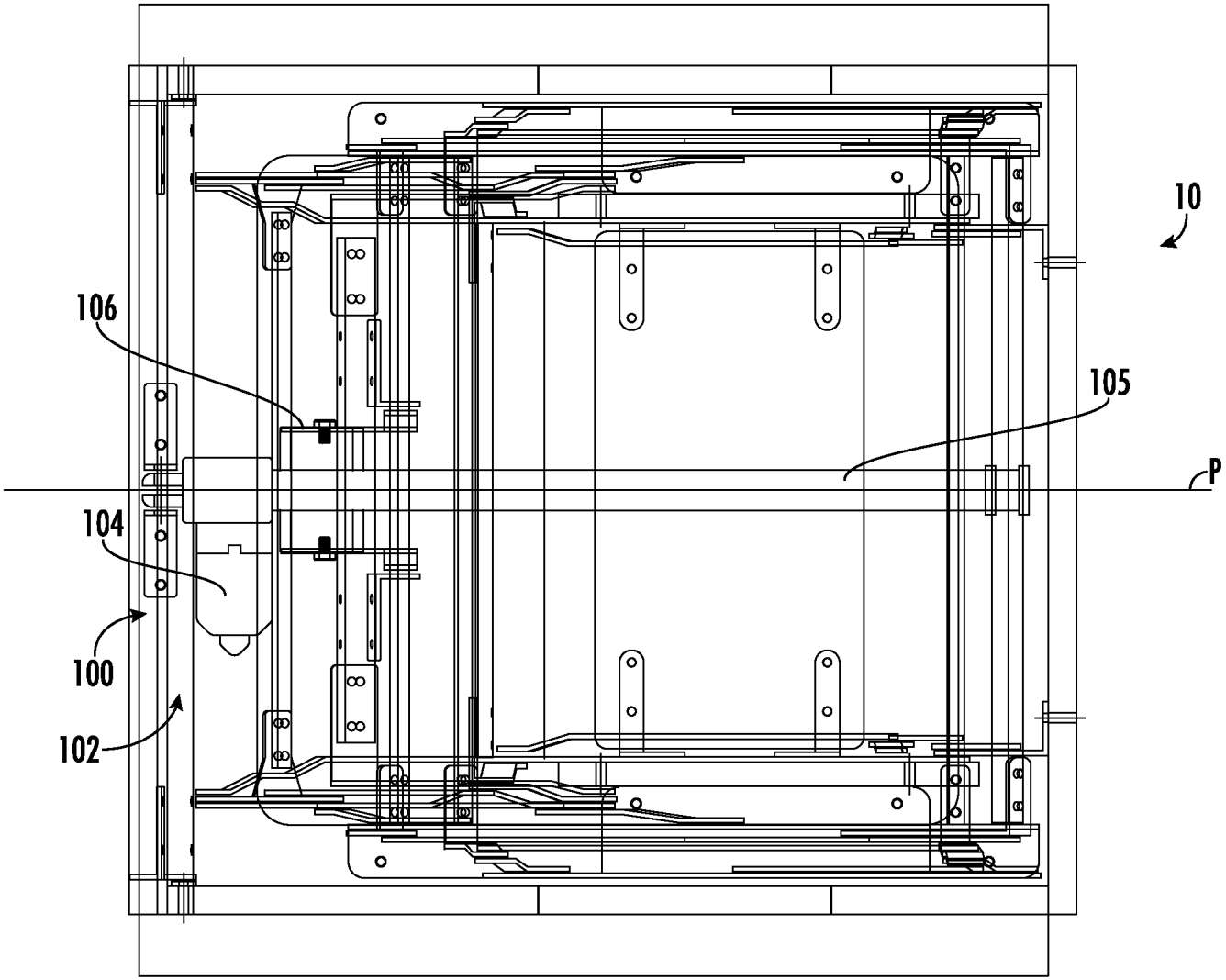
FIG. 5 is a top view of the seating unit of FIG. 1, shown in the upright position.
Figure 6A:
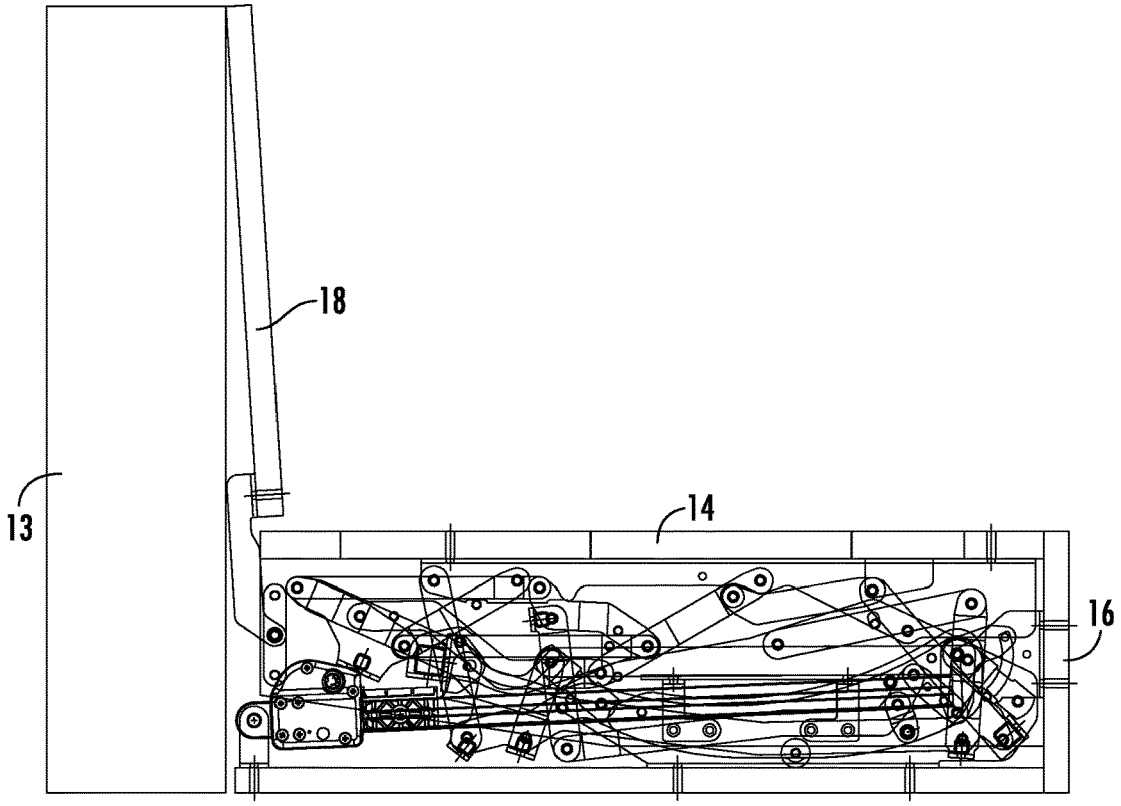
FIGS. 6A-6F are sequential views of the seating unit of FIG. 1 showing different positions of links of the reclining mechanism and footrest linkage as the seating unit moves between the upright and TV positions.
Figure 6B:
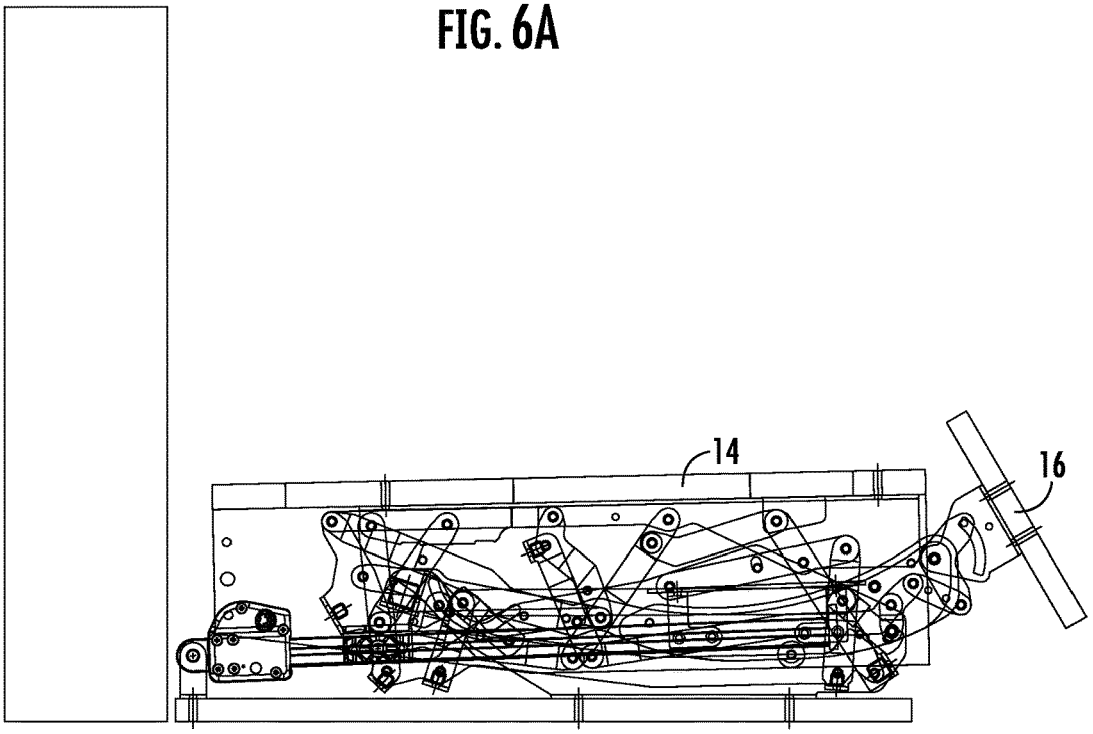
Figure 6C:
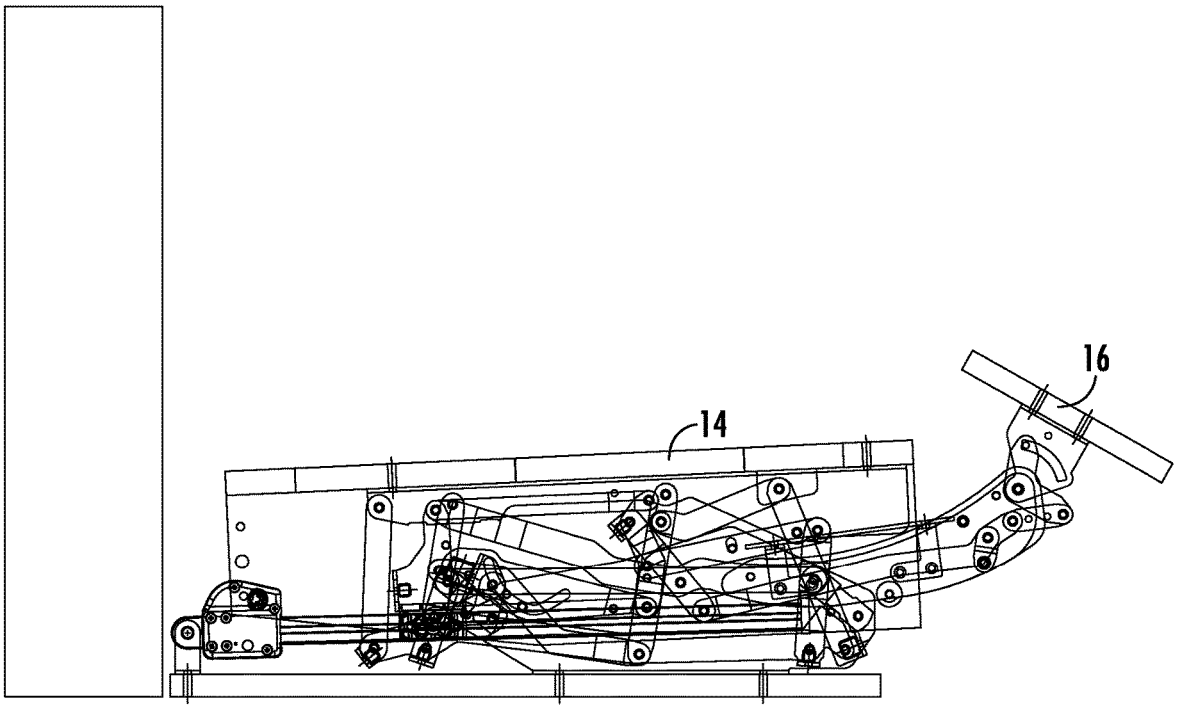
Figure 6D:
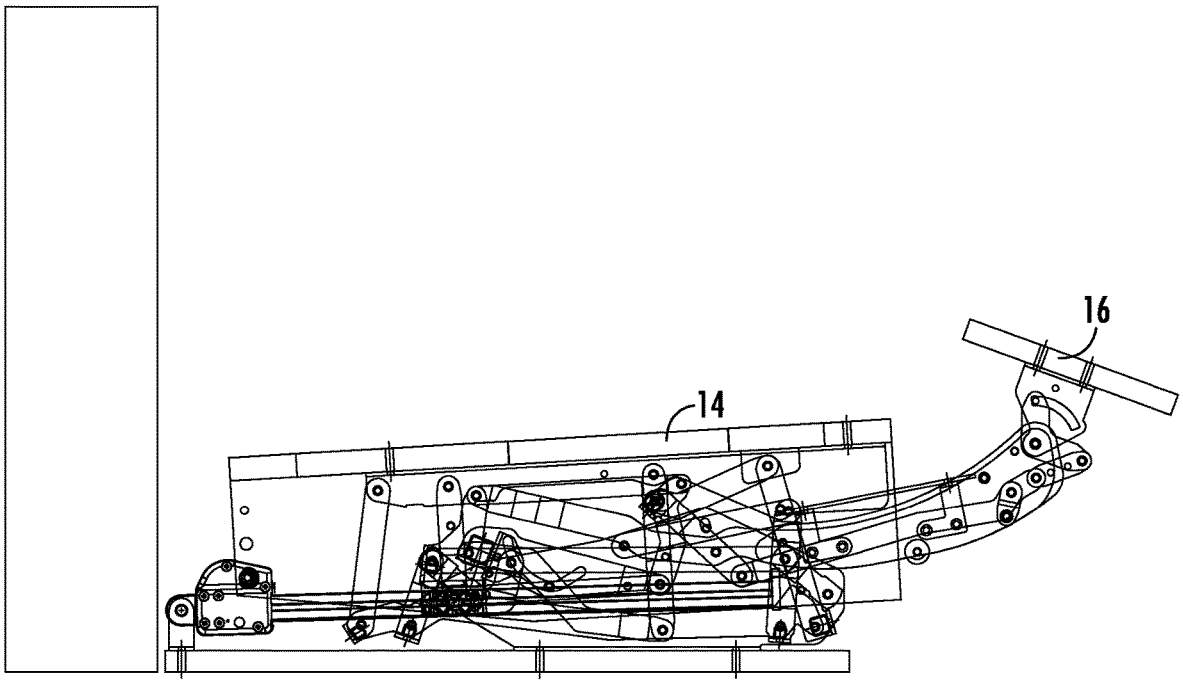
Figure 6E:
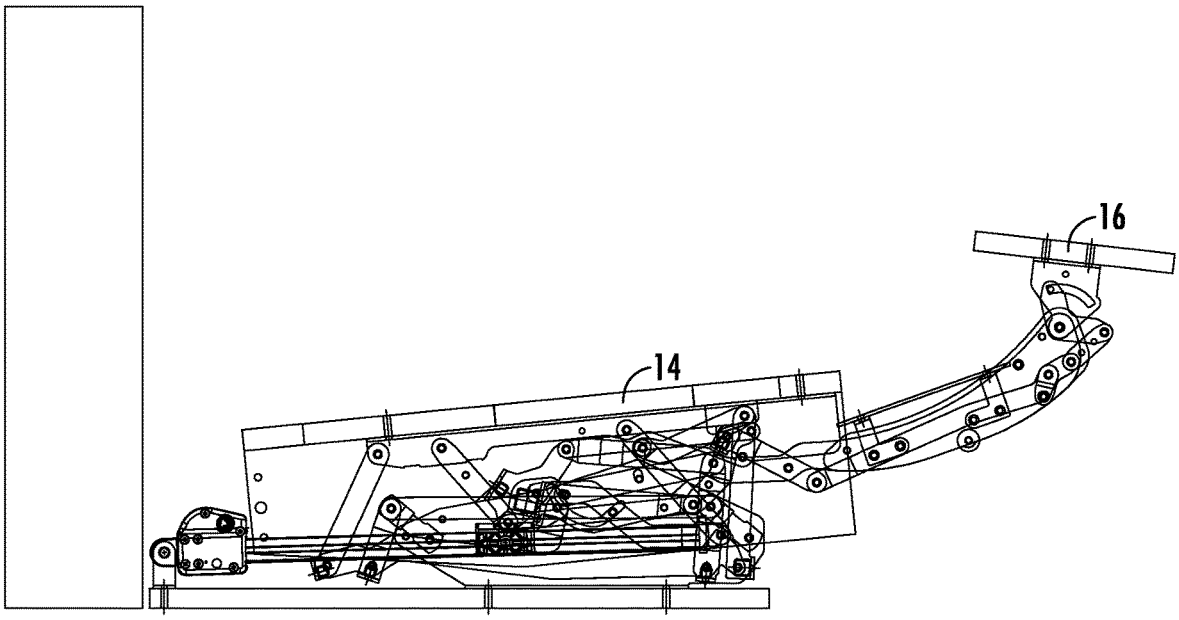
Figure 6F:
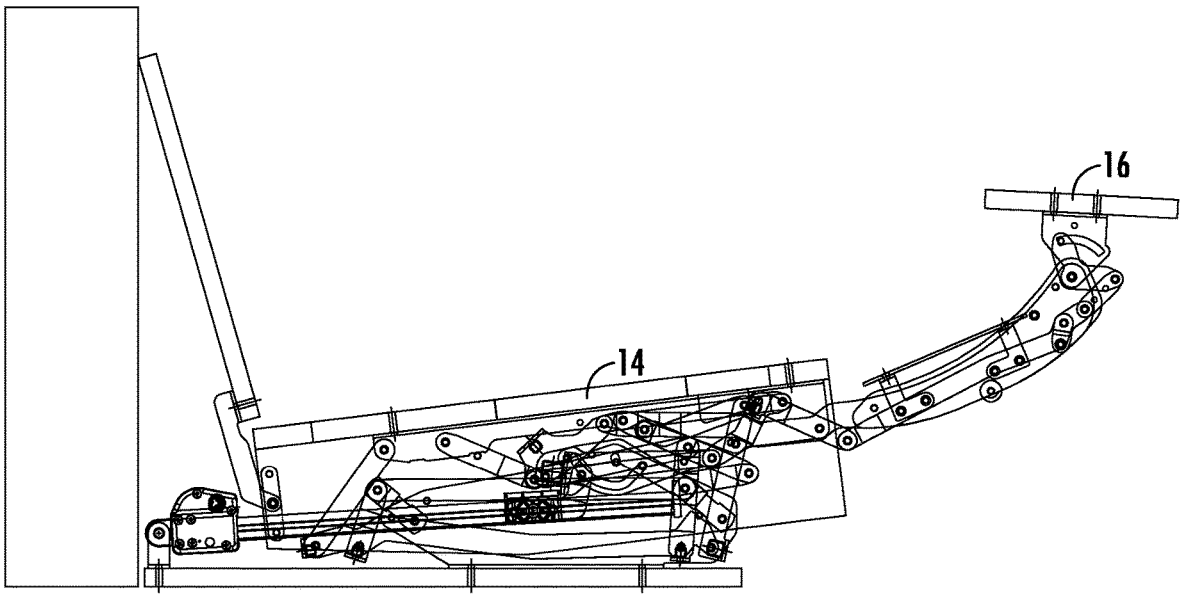

Also notable, as illustrated in FIG. 4, is the ability of the footrest 16 to pivot toward the occupant when the seating unit 10 is in either the TV or fully reclined position. Some occupants may prefer to place the soles of their feet directly on the upper surface of the footrest 16, and this position allows this. The footrest 16 is typically biased in the position shown in FIGS. 2 and 3 by a spring (not shown), but can be pivoted to the position shown in FIG. 4 simply by applying pressure to the rearward edge of the footrest 16.

Those of skill in this art will recognize that a user may position the seating unit 10 in any position between the upright position of FIG. 1 and the fully reclined position of FIG. 3 simply by halting operation of the linear actuator 102.

Figure 8:
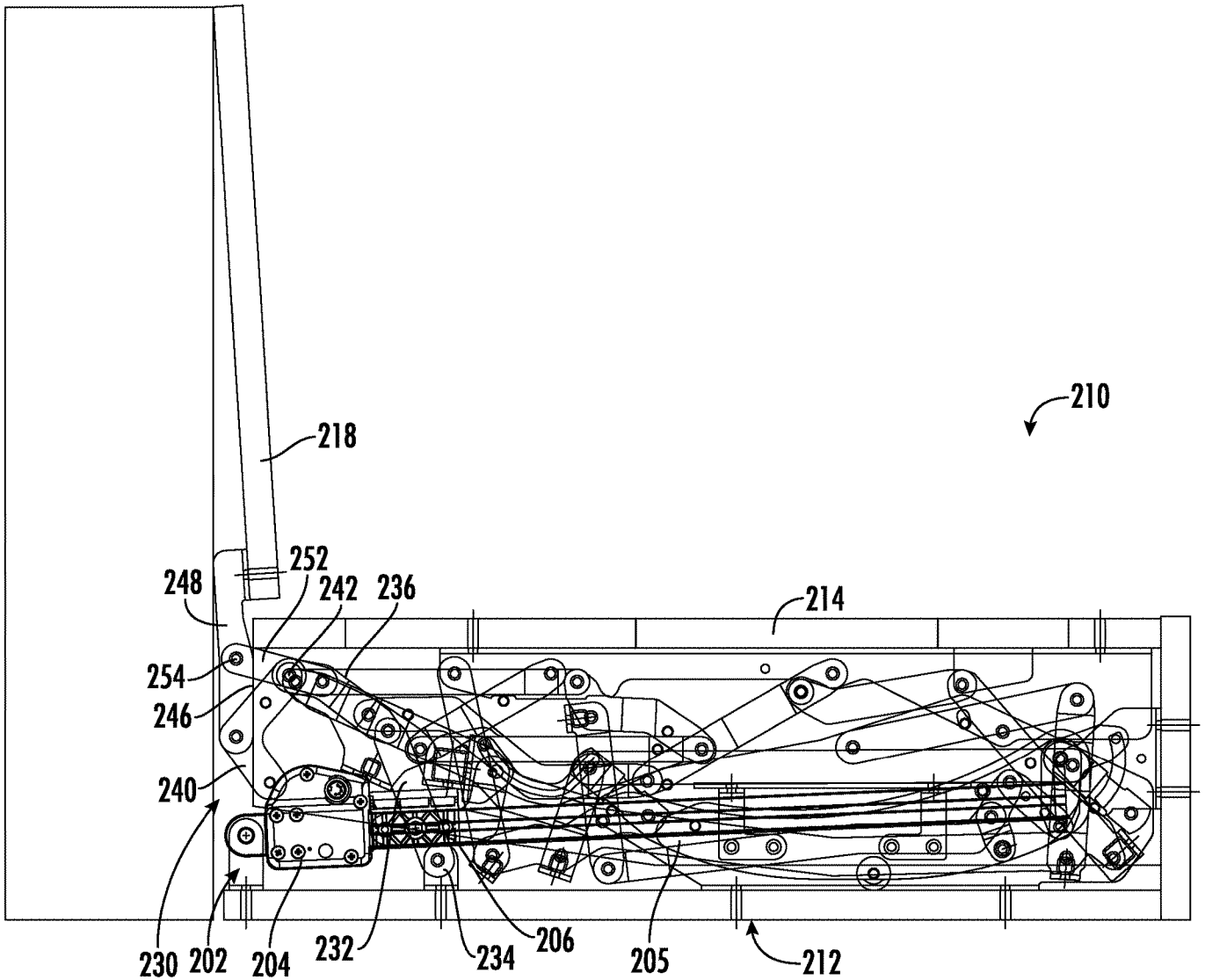
FIG. 8 is a side view of a seating unit according to alternative embodiments of the invention, wherein the seating unit is shown in the upright position.
Figure 9:
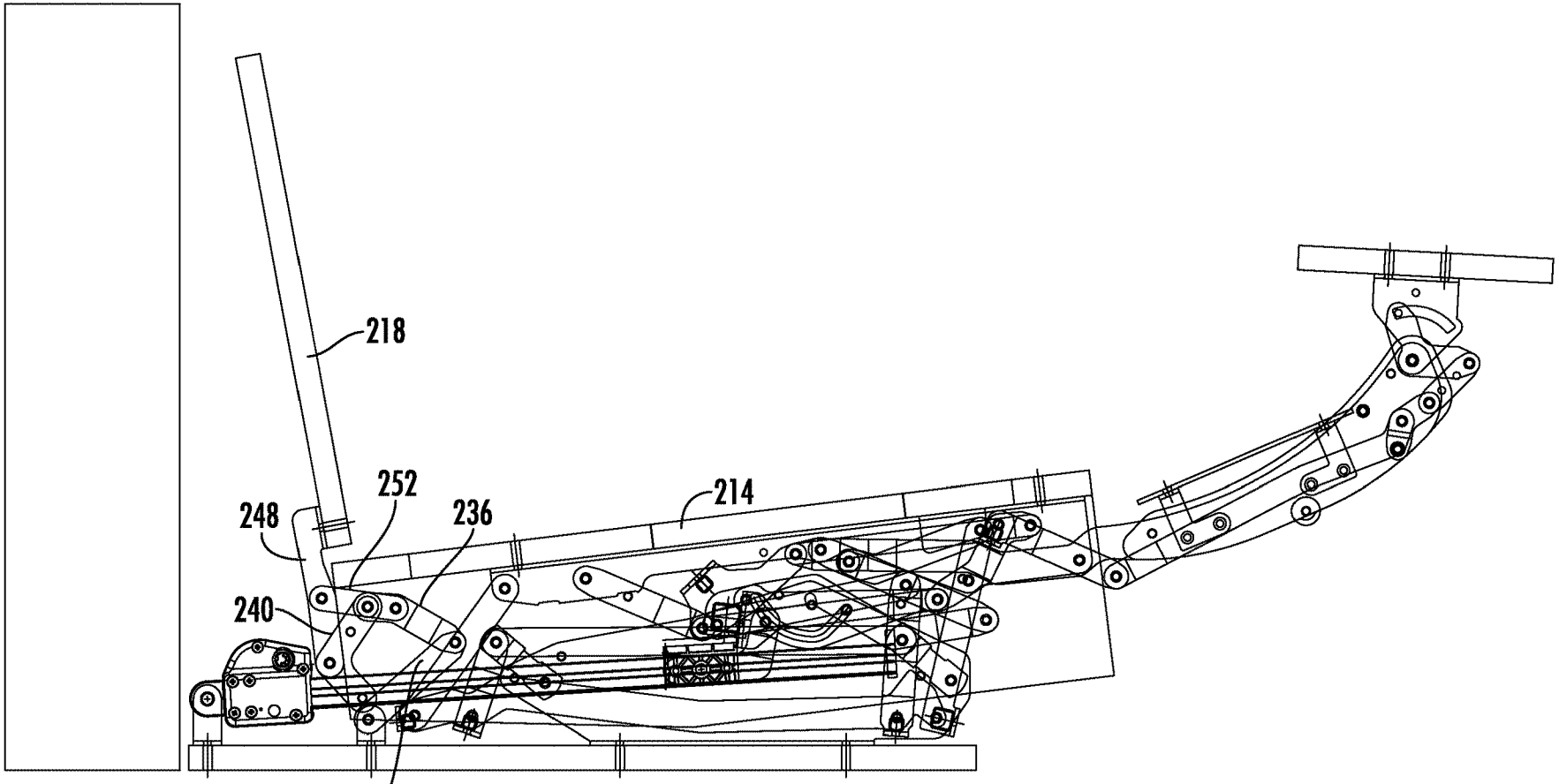
FIG. 9 is a side view of the seating unit of FIG. 8, shown in the TV position.
Figure 10:
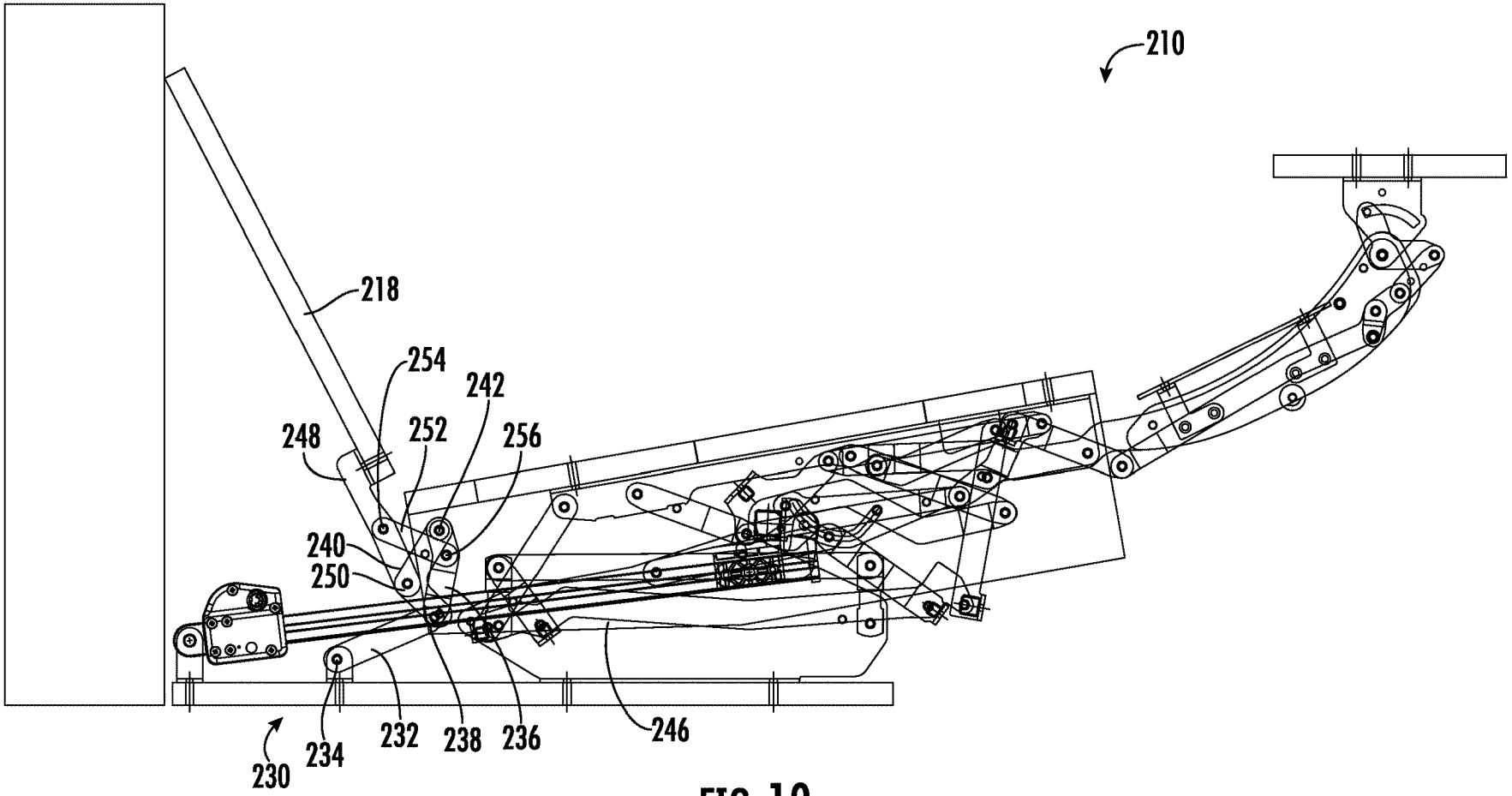
FIG. 10 is a side view of the seating unit of FIG. 8, shown in the fully reclined position.

Referring now to FIGS. 8-10, another seating unit, designated broadly at 210, is illustrated therein. The seating unit 210 is similar to the seating unit 10, with the exception that, rather than having a backrest that is attached to the seat by a single pivot and that operates via gravity, the backrest 218 of the seating unit 210 is driven to recline in the TV and fully reclined positions by a backrest mechanism 230. The backrest mechanism 230 is described in detail below.

The backrest mechanism 230 includes a backrest drive link 232 that is attached to the base 212 at a pivot 234. The backrest drive link 232 extends upwardly and forwardly to a pivot 238 with a connecting link 236. The connecting link 236 extends upwardly to attach to an angled link 240 at a pivot 242. The angled link 240 is fixed to a side board 246 that is in turn fixed to the seat 222, with the vertex of the angled link 240 extending beyond the rear edge of the side board 246. A backpost 248 is attached to the vertex of the angled link 240 at a pivot 250. The backpost extends upwardly and rearwardly to a fixed attachment with the backrest 218. A control link 252 is attached at its rear end to the backpost at a pivot 254 and to the connecting link 236 at a pivot 256.

In the upright position (FIG. 8), the angled link 240 is positioned above and just rearwardly of the motor 204 of the linear actuator 202. The backrest drive link 232 extends upwardly and rearwardly from the pivot 234. The connecting link 236 extends upwardly and rearwardly to the pivot 242. The control link 252 extends generally rearwardly to the pivot 254. As a result, the backpost 248 (and in turn the backrest 218) are substantially vertically disposed.

As the carriage 206 of the linear actuator 202 moves forwardly on the rail 205, the seat 214 moves forwardly as described above. Because the seat 214 moves forward, the side board 246 also moves forward relative to the base 212. This movement forces the connecting link 236 forward, which rotates the backrest drive link 232 clockwise about the pivot 234. The relationship between the connecting link 236, the control link 252, and the backrest 248 remains substantially the same; as a result, the backrest 218 reclines slightly in response to the increase in the seat pitch angle, but otherwise moves very little relative to the seat 214. As a result, the backrest 218 reclines only slightly more relative to horizontal than in the upright position.

Referring now to FIG. 10, as the seating unit 210 moves to the fully reclined position, the forward movement of the seat 214 continues to rotate the backrest drive link 232 about the pivot 234. This movement rotates the connecting link clockwise relative to the backrest drive link about the pivot 238. This movement draws the control link 252 forward, which in turn rotates the backpost 248 counterclockwise above the pivot 250 to a more reclined position.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A reclining seating unit, comprising:

an armless base;

a stationary backrest attached to the base;

a seat;

a footrest;

a reclining backrest;

a reclining mechanism attached to the base, the seat, the footrest and the reclining backrest, the reclining mechanism comprising a plurality of pivotally interconnected links configured and arranged to move the seating unit between (a) an upright position, in which the reclining backrest is substantially vertical and just forward of the stationary backrest, the seat is substantially horizontal and positioned above the base and just forward of the reclining backrest, and the footrest is generally vertically disposed adjacent and below a front portion of the seat, (b) a TV position, in which the seat is moved forwardly relative to the base and takes a first pitch angle relative to horizontal, and the footrest is generally horizontally disposed and positioned in front of the seat, and (c) a fully reclined position, in which the seat is moved farther forward relative to the base, the reclining backrest takes a backrest angle relative to horizontal;

wherein in the upright position, the reclining mechanism is between about 26 and 30 inches in length, and between about 6.5 and 8 inches in height.

2. The reclining seating unit defined in claim 1, wherein the footrest does not move relative to the seat as the seating unit moves between the TV and fully reclined positions.

3. The reclining seating unit defined in claim 1, wherein the reclining backrest is attached to the reclining mechanism.

4. The reclining seating unit defined in claim 3, wherein the reclining backrest and the seat define a first angle in the upright and TV positions and a second, different angle in the fully reclined position.

5. The reclining mechanism defined in claim 1, wherein the reclining mechanism includes a foundation plate fixed to the base and a carrier link, wherein the carrier link remains stationary relative to the foundation plate in the upright and TV positions, but moves forwardly relative to the foundation plate as the seating unit moves from the TV position to the fully reclined position.

6. The reclining seating unit defined in claim 1, wherein the reclining mechanism includes a linear actuator to drive the seating unit between the upright, TV and fully reclined positions.

7. The reclining seating unit defined in claim 1, wherein in the fully reclined position the seat takes a second pitch angle that is steeper than the first pitch angle.

8. The reclining seating unit defined in claim 1, wherein the reclining mechanism includes an upper footrest extension link and a footrest bracket, wherein the footrest bracket is fixed to the footrest, and wherein the footrest bracket is directly pivotally attached to the upper footrest extension link at a front end of the upper footrest extension link, and wherein a rear end of the upper footrest extension link is positioned adjacent a rear end of the seat.

9. The reclining seating unit defined in claim 6, wherein the reclining mechanism includes (a) a drive link that is pivotally attached to a movable carriage of the linear actuator, an actuation transition link that is pivotally attached to the drive link and to the seat, and a coupling link that is pivotally attached to the actuation transition link, wherein the drive link includes an arcuate slot and the coupling link includes a pin that is received in the arcuate slot.

10. A reclining seating unit, comprising:

a base;

a stationary backrest attached to the base;

a seat;

a footrest;

a reclining backrest;

a reclining mechanism attached to the base, the seat, the footrest and the reclining backrest, the reclining mechanism comprising a plurality of pivotally interconnected links configured and arranged to move the seating unit between (a) an upright position, in which the reclining backrest is substantially vertical and just forward of the stationary backrest, the seat is substantially horizontal and positioned above the base and just forward of the reclining backrest, and the footrest is generally vertically disposed adjacent and below a front portion of the seat, (b) a TV position, in which the seat is moved forwardly relative to the base and takes a first pitch angle relative to horizontal, and the footrest is generally horizontally disposed and positioned in front of the seat, and (c) a fully reclined position, in which the seat is moved farther forward relative to the base, the reclining backrest takes a backrest angle relative to horizontal; and a linear actuator that includes a rail and a carriage movable on the rail, the linear actuator attached to the reclining mechanism and configured to move the seating unit between the upright, TV and fully reclined positions;

wherein the reclining mechanism includes an upper footrest extension link and a footrest bracket, wherein the footrest bracket is fixed to the footrest, and wherein the footrest bracket is directly pivotally attached to the upper footrest extension link at a front end of the upper footrest extension link, and wherein a rear end of the upper footrest extension link is positioned adjacent a rear end of the seat when the seating unit is in the upright position; and wherein the reclining mechanism further includes (a) a drive link that is pivotally attached to the carriage of the linear actuator, an actuation transition link that is pivotally attached to the drive link and to the seat, and a coupling link that is pivotally attached to the actuation transition link, wherein the drive link includes an arcuate slot and the coupling link includes a pin that is received in the arcuate slot.

11. The reclining seating unit defined in claim 10, wherein in the fully reclined position the seat takes a second pitch angle that is steeper than the first pitch angle.

* * * * *